US005423263A

United States Patent [19]

Rontey et al.

[11] Patent Number: 5,423,263

[45] Date of Patent: Jun. 13, 1995

[54] DETONATOR-TO-SHOCK TUBE IGNITION TRANSFER CONNECTOR

[75] Inventors: Daniel Rontey, Woodstock; David Steedman, Kingston, both of N.Y.

[73] Assignee: Dyno Nobel, Inc., Salt Lake City, Utah

[21] Appl. No.: 222,076

[22] Filed: Apr. 1, 1994

[51] Int. Cl.[6] ..... C06C 5/04

[52] U.S. Cl. ..... 102/275.12; 102/275.7

[58] Field of Search ..... 102/275.12, 275.7, 275.4, 102/275.5, 275.6, 275.3, 275.2

[56] References Cited

U.S. PATENT DOCUMENTS

| | | | |
|---|---|---|---|
| 3,175,491 | 3/1965 | Robertson | 102/275.7 |
| 3,205,818 | 9/1965 | Coulson | 102/275.7 |
| 4,248,152 | 2/1981 | Yunan | 102/275.4 |
| 4,495,867 | 1/1985 | Mitchell et al. | 102/275.4 |
| 4,714,017 | 12/1987 | Kelly et al. | 102/275.3 |
| 4,714,018 | 12/1987 | Löfgren | 102/275.7 |
| 4,722,279 | 2/1988 | Yunan | 102/275.4 |
| 5,171,935 | 12/1992 | Michna et al. | 102/275.7 |
| 5,204,492 | 4/1993 | Jacob et al. | 102/275.12 |
| 5,299,500 | 4/1994 | Lindquist et al. | 102/275.12 |

*Primary Examiner*—David Brown

*Attorney, Agent, or Firm*—Thorpe North & Western

[57] ABSTRACT

A detonator-to-shock tube ignition transfer connector for bi-directional explosive transfer from a detonator to one or more shock tubes is disclosed wherein the connector has a housing defining a barrel portion for enclosing a detonator assembly, the barrel portion having an opening at both ends, and a coupling attached to one end of the barrel portion. The coupling and the barrel portion form a coupling channel for holding shock tubes within the path of an explosive force created when a detonator assembly positioned in the barrel portion is ignited, thereby initiating the shock tubes. The invention also includes a collar lock for holding the detonator assembly within the barrel portion and preventing the detonator assembly from being accidentally removed.

18 Claims, 6 Drawing Sheets

DETONATOR-TO-SHOCK TUBE IGNITION TRANSFER CONNECTOR

BACKGROUND OF THE INVENTION

The present invention relates to a device for use in blasting, and more particularly to an improved connector for coupling a detonator to one or more transmitting tubes to allow for bidirectional explosive transfer from the detonator to the transmitting tubes.

When detonating a plurality of blasting charges in a given pattern, it is important that each charge be detonated at precisely the right time. To ensure that the charges detonate in the proper order and within the required time parameters, one or more main lines are often connected to a plurality of transmitting tubes or "shock tubes" of varying lengths. Ignition of the main line ignites an output blast which is located in the connector. This, in turn, initiates the shock tube(s) which carry an ignition signal to their respective charges. The charges then detonate in an order dependent on the length of each shock tube and the presence of any delay devices such as a delay detonator.

Shock tubes and blasting patterns are well-known in the explosives art. For example, U.S. Pat. No. 4,607,573 discloses a transmitting tube which has come to be known as a shock tube. The use of transmitting tubes and connectors in blasting patterns is disclosed in U.S. Pat. Nos. 3,878,785 and 3,987,732.

The use of transfer connectors to couple a detonator to multiple shock tubes is also well-known. For example, U.S. Pat. No. 5,171,935 discloses a surface connector for coupling a detonator to transmitting tubes for use in non-directional signal transmission. Despite the knowledge of transfer connectors and shock tubes, there remain several significant problems surrounding their use. For example, the detonation of the explosive element within the connector often produces high energy projectile fragments, endangering workers and occasionally disrupting the initiation of other shock tubes in the pattern. Current designs also allow for the detonator or transmitting tubes to be accidentally pulled from the connector, causing an initiation failure. In addition to resolving these concerns, a detonator to shock tube ignition connector must be easy to manufacture in order to economically provide safe blasting.

SUMMARY OF THE INVENTION

It is a primary object of the invention to provide a shock tube ignition connector in which the amount of explosive needed to initiate the shock tubes is reduced.

It is another object of the invention to provide a shock tube ignition connector in which the amount of shrapnel is reduced.

It is an additional object of the invention to provide a shock tube ignition connector in which the detonator is locked into the connector and is positioned in the proper location by the lock.

It is another object of the invention to provide a shock tube connector which allows for simple and secure placement of the shock tubes adjacent to the explosive end of the shock tube connector.

It is an additional object of the invention to prevent the easy removal of the shock tubes once placed adjacent to the explosive end of the connector.

The above and other objects of the invention are realized in an illustrative embodiment of a detonator-to-shock tube ignition transfer connector which includes a connector housing having a barrel portion which forms an elongate chamber. The chamber is formed to receive a detonator assembly in such a way that the explosive component of the assembly is substantially laterally surrounded by the connector housing and located near an open end of the barrel portion. Typically, such a detonator assembly would include a shock tube which enters a cylindrical metal casing. Contained within the casing would be: a static isolation cup positioned next to the end of the shock tube; a sealer element or a transition element disposed adjacent to the static isolation cup; a delay train charge disposed on the side of the sealer or transition element opposite the isolation cup; and an explosive output charge disposed adjacent to the delay train charge. Initiation of the shock tube causes an initiation/ignition signal to pass through the other elements, finally igniting the output charge. The typical arrangement and function of each of these elements is well-known to those skilled in the art.

In accordance with one aspect of the invention, a resilient coupling portion extends from the end of the barrel portion at which the output charge is located. The coupling extends in a coplanar direction to the barrel portion and then turns to be transverse to the longitudinal axis of the barrel. The coupling portion and the end of the barrel thus form a channel positioned such that shock tubes passing through the channel are transverse to the direction of an explosive force caused by ignition of the output charge. When the output charge is ignited, the explosive force travels into the coupling channel and causes bi-directional initiation of each shock tube. A small flange can extend from the barrel portion so as to create a groove-type opening with the coupling which prevents the removal of shock tubes once placed in the coupling channel. Thus, a shock tube cannot be inadvertently removed from the connector prior to initiation.

In accordance with another aspect of the invention, the barrel portion has a U-shaped collar which enables the user to lock the detonator assembly within the barrel portion. The locking arrangement prevents the detonator assembly from accidentally being pulled from the barrel portion.

DETAILED DESCRIPTION

Figure 1:
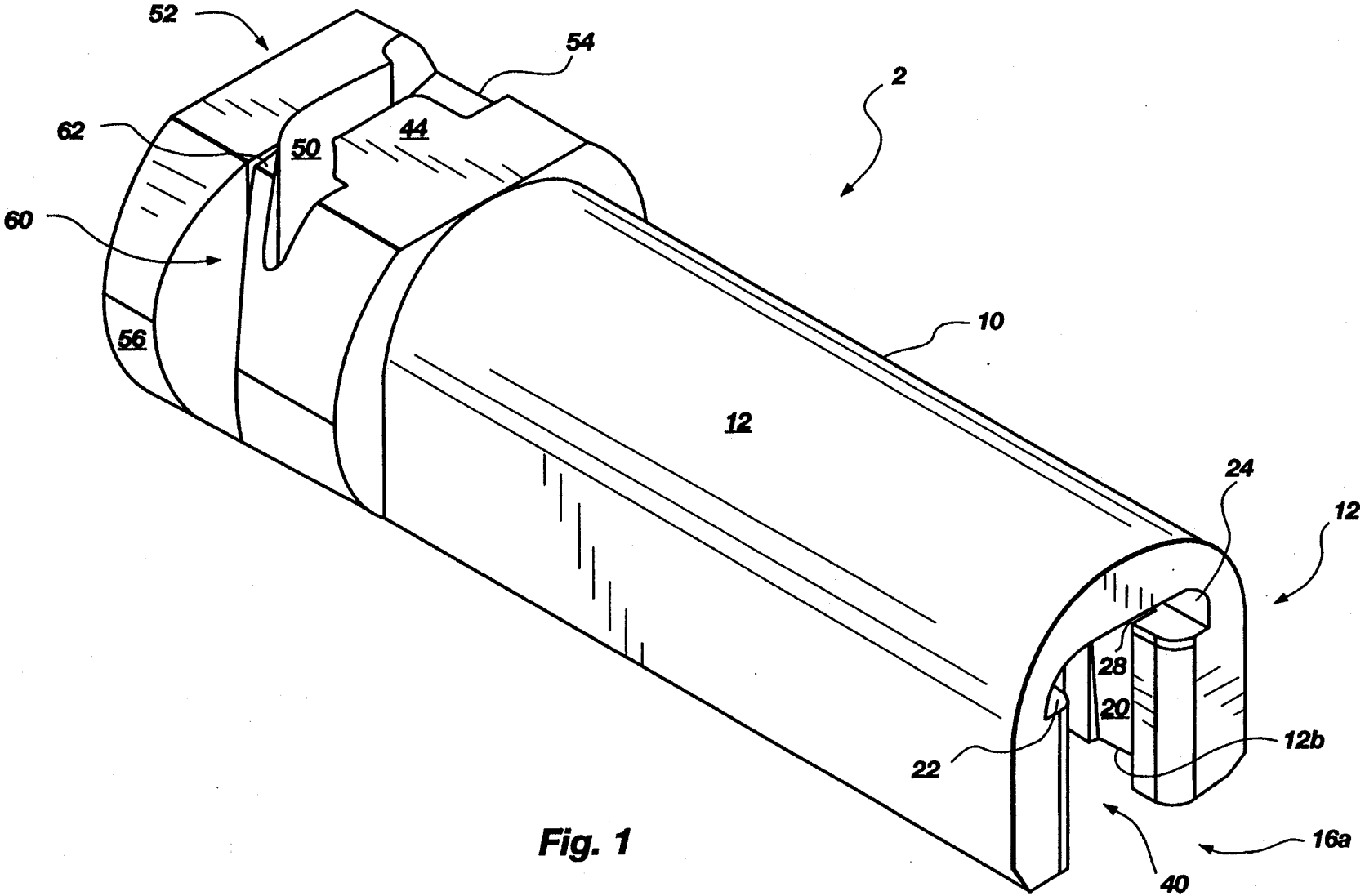
FIG. 1 is a perspective view of a detonator-to-shock tube ignition connector illustrative of the present invention.
Figure 2:
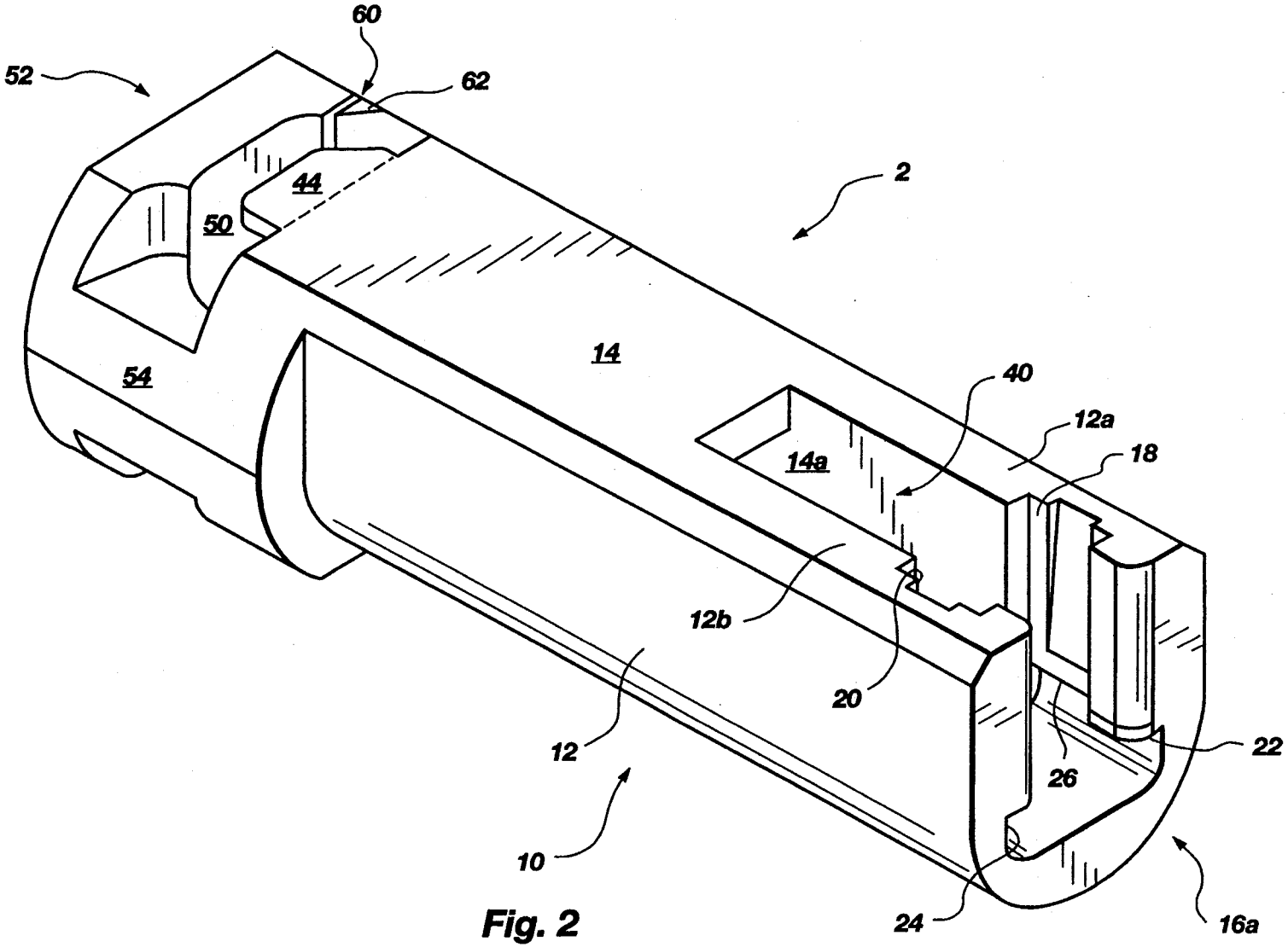
FIG. 2 shows a bottom perspective view of the connector illustrative of the present invention.
Figure 3:
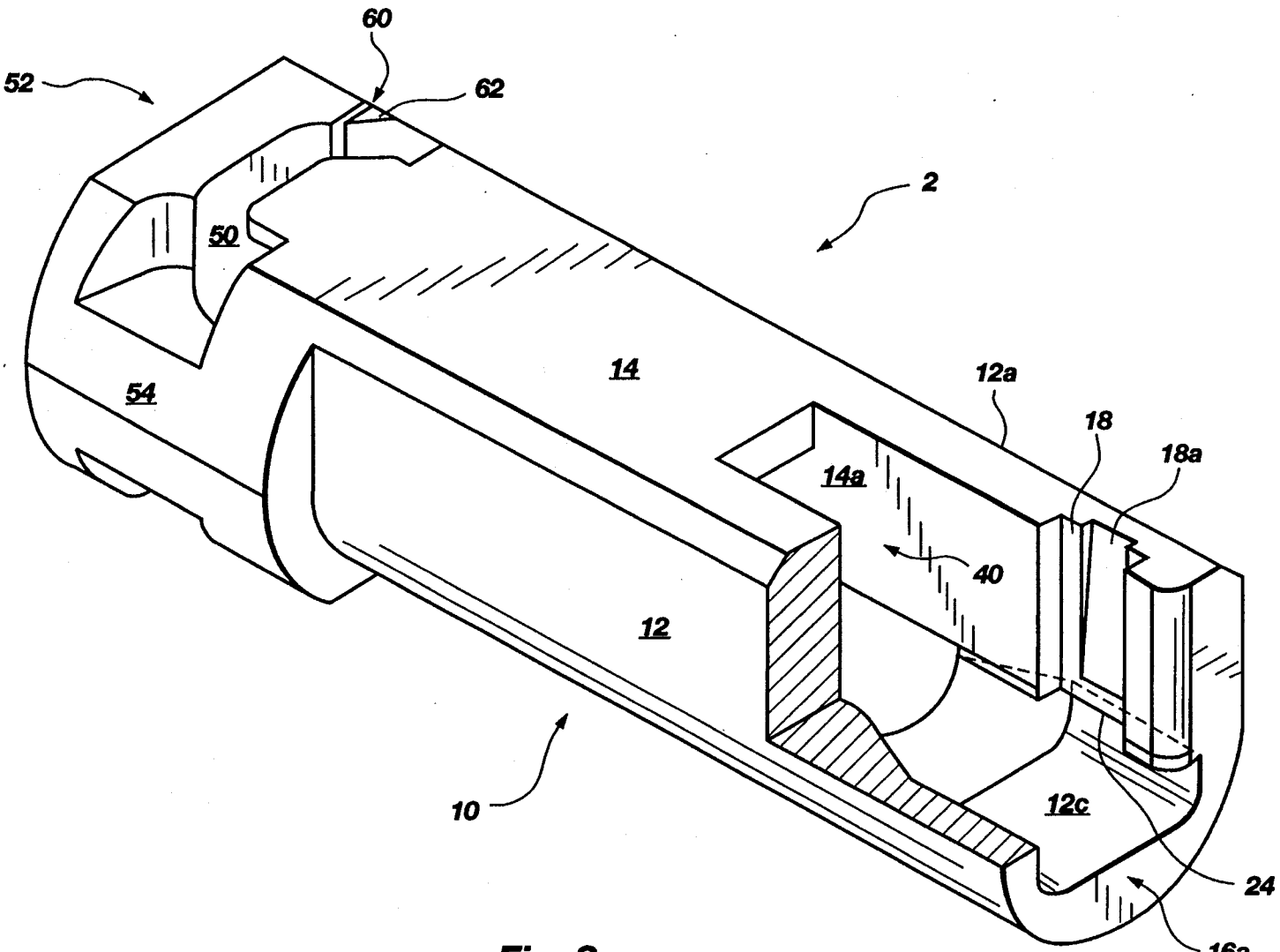
FIG. 3 is a bottom, partially cutaway perspective view of a connector of the present invention.
Figure 4B:
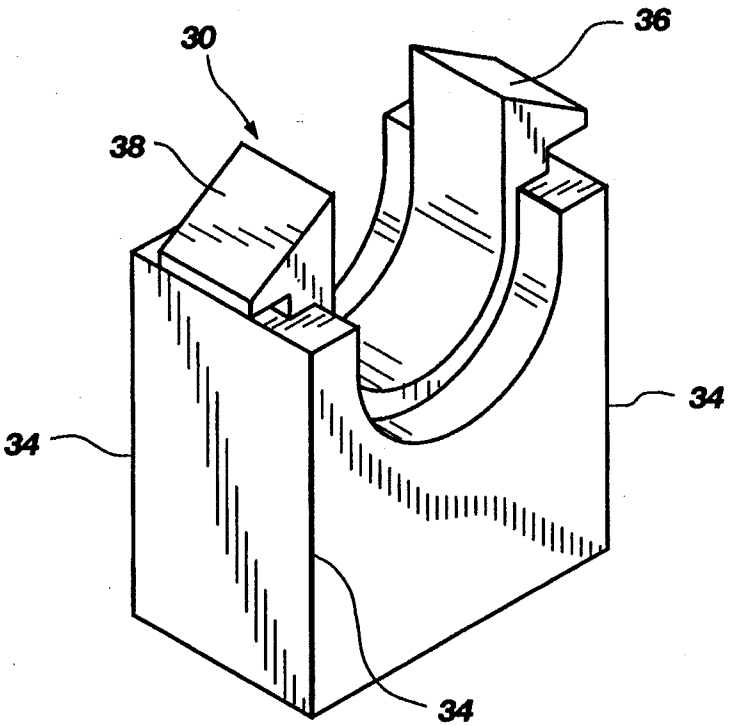
FIGS. 4*a* & 4*b* show two perspective views of a U-shaped collar lock for use in the present invention.
Figure 4A:
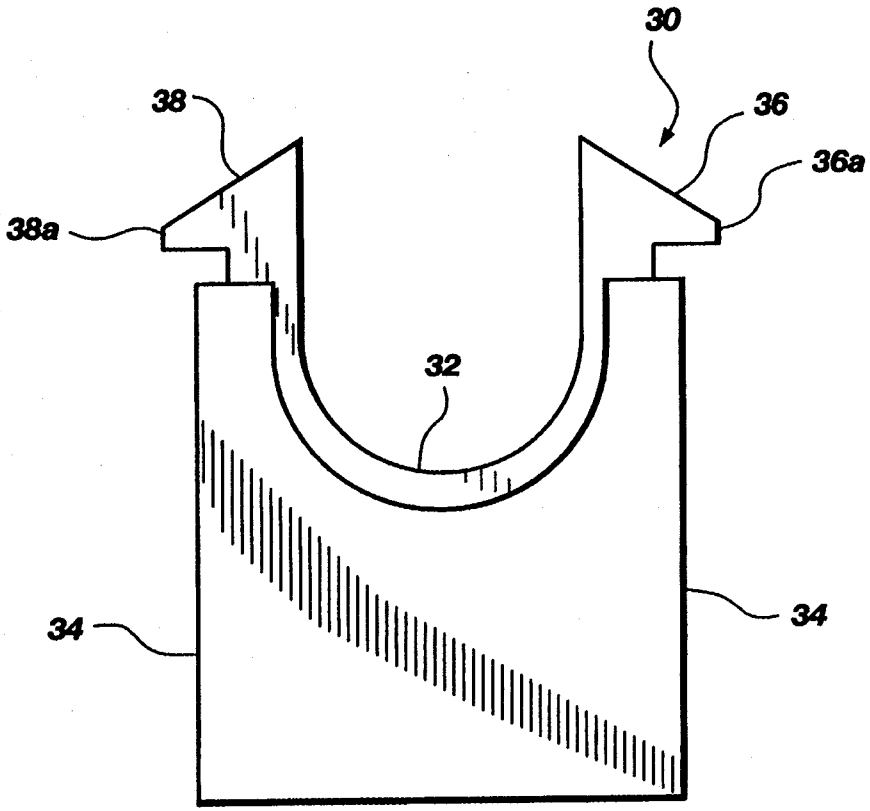
Figure 6:
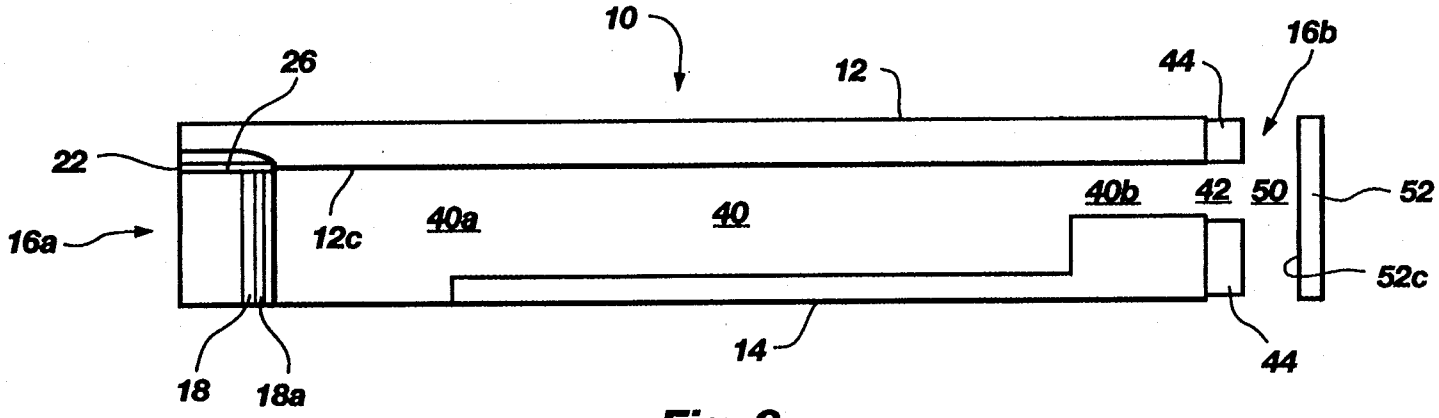
FIG. 6 is a side cross-sectional view of the detonator-to-shock tube ignition connector of the present invention.
Figure 5:
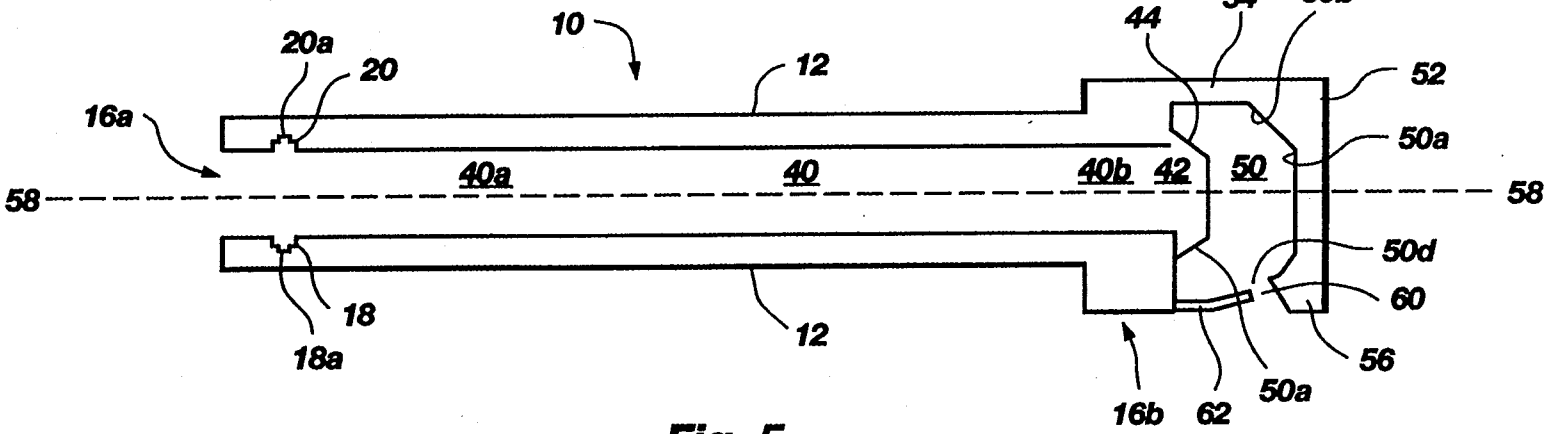
FIG. 5 shows a top cross-sectional view of a connector made in accordance with the invention.

Referring to FIGS. 1–6, there is shown an illustrative embodiment of a detonator-to-shock tube ignition connector made in accordance with the present invention and including a connector housing 2 made, for example, of plastic, or some other durable, resilient material. Referring to FIGS. 1–3, specifically, the connector housing 2 includes a barrel portion 10 and a coupling portion 52 (discussed below). The barrel portion 10 is open at a first end 16*a* and a second end 16*b* (see FIG. 6), and has a top side 12 and a bottom side 14 (FIGS. 2 & 3). A slotted opening 14*a* is formed in the bottom side 14, and extends from the open first end 16*a* to an intermediate position along the bottom side 14. Thus, the barrel portion 10 is hollow, forming a partially enclosed elongate chamber 40 which begins at the open first end 16*a* of the barrel portion 10 and terminates with an opening 42 (FIGS. 5 & 6) at the second end 16*b* (FIGS. 5 & 6). The elongate chamber 40 and the opening 42 are discussed in detail below.

Located in the barrel portion 10 are two side walls 12*a* and 12*b*. Near the first end 16*a*, vertical grooves 18 and 20 (FIG. 2) are formed in the walls 12*a* and 12*b*, respectively. In the present embodiment of the invention, the vertical grooves begin at the slotted opening 14*a* and continue to a position near a top wall 12*c* (FIG. 3). A horizontal groove is formed at the top of each vertical groove. As is demonstrated by horizontal grooves 22 and 24, respectively, the horizontal grooves are deeper than the vertical grooves 18 and 20, forming a small lip 26 and 28 at the top of each vertical groove.

The vertical grooves 18 and 20 allow a U-shaped collar 30 (as shown in FIGS. 4*a* & 4*b*) to be placed in the chamber 40 to provide a narrow opening between the collar 30 and the top wall 12*c*. Referring now to FIGS. 4*a* and 4*b*, an inner face 32 of the U-shaped collar 30 is designed to hold part of the detonator assembly so that the assembly is properly positioned within the connector housing 2. The U-shaped collar 30 is formed of a resilient material and has a plurality of ridges 34 which complement the sides of the vertical grooves 18 and 20, thus allowing the collar to be slid vertically, the ridges 34 sliding within the grooves 18 and 20. At the top of each side of the U-shaped collar 30 is a barb 36 and 38. As the U-shaped collar 30 is slid within the grooves 18 and 20, the barbs 36 and 38 are compressed towards each other. Once the barbs 36 and 38 pass the lips 26 and 28, respectively, the resilient collar 30 forces the flanges 36*a* and 38*a* of the barbs 36 and 38 into the horizontal grooves 22 and 24, locking the collar 30 in place, and pinning the detonator assembly between the innerface 32 of the U-shaped collar 30 and the top wall 12*c* of the barrel portion 10. As is shown in FIG. 5, the vertical grooves 18 and 20 can also have narrower vertical grooves positioned therein, indicated at 18*a* and 20*a*, to assist in directing the flanges 36*a* and 38*a* of the barbs 36 and 38 into communication with the lips 24 and 28.

Referring to FIGS. 5 & 6, the barrel portion 10 also defines a chamber 40 which is configured to receive a detonator assembly (not shown). The barrel portion 10 substantially encloses the detonator assembly so as to prevent the projection of high energy fragments away from the connector when the detonator assembly is detonated. The chamber 40 can be virtually any shape. In the preferred embodiment, however, the chamber 40 is cylindroidal at first section 40*a*, which extends from the open first end 16*a* to a point near the second end 16*b* of the barrel portion. The chamber then changes shape to be generally cylindrical in a shorter second section 40*b* disposed at the second end 16*b*. In the present embodiment, the cylindrical second section 40*b* is of a diameter smaller than that of the first section 40*a* so as to provide a seat for the explosive component of the detonator assembly.

The cylindrical second section 40*b* leads into an opening 42. The opening 42 is defined by two ridges 44 which extend from the second end 16*b*. The opening 42, in turn, leads into a shock tube coupling channel 50. The ignition of a detonator assembly positioned in chamber 40 causes an explosive force to travel from section 40*b*, through opening 42, and into the shock tube coupling channel 50.

Referring to FIG. 5, specifically, the channel 50 is enclosed on a first side 50*a* by the second end 16*b* and the ridges 44 thereon. On a second side 50*b*, adjacent to the first side, and on a third side 50*c*, opposite the first side, the channel 50 is defined by an L-shaped coupling portion 52 which is attached at a first end 54 to the second end 16*b* of the barrel portion 10. In a preferred embodiment, the third side 50*c* will be disposed perpendicular to the longitudinal axis 58 of the chamber 40 (as shown in FIG. 5). At a fourth side 50*d*, opposite the second side 50*b*, is a groove-type opening 60 formed by a second end 56 of the coupling portion 52 and a flange 62 extending from the second end 16*b*. The second end 56 of the coupling portion 52 is disposed on a side of the second end 16*b* of the barrel portion 10 that is generally opposite to the side of the second end 16*b* which is attached to the first end 54 of the coupling portion. Due to the ridges 44, the coupling portion 52, and the flange 58, the channel 50 is essentially C-shaped. The C-shape enables the shock tubes to be held generally equidistant from the explosive end of the detonator assembly in the chamber 40.

The groove-type opening 60 forms a latch and catch mechanism in that its opening is of smaller width than the shock tube coupling channel 50 and the diameter of the shock tube. The shock tube is placed in the channel 50 by a slight elastic deformation of the coupling portion 52. The deformation is caused by placing pressure on the second end 56 and forcing it away from the flange 62. Once the shock tube has passed through the groove-type opening 60 and the force on the second end 56 is released, the resilient nature of the coupling portion 52 returns the second end 56 to its original position, thereby coupling the shock tube in the channel 50 between the coupling portion 50 and the ridges 44. The resting position of the flange 62 and coupling portion 52 form a "valve" which is unidirectional. The shock tubes can be forced into the channel 50 within the elastic limits of the plastic coupling portion 52, but cannot be removed without deforming the plastic coupling portion beyond its elastic limits.

The channel 50 is positioned to hold one or more shock tubes transverse to the axis 58 about which the chamber 40 is disposed. As the channel 50 holds the shock tubes adjacent to the opening 42, an explosive force passing out of the opening will contact the shock tubes, thus initiating them in both directions. The barrel portion 10 limits the amount of shrapnel emitted by the explosion.

Figure 7:
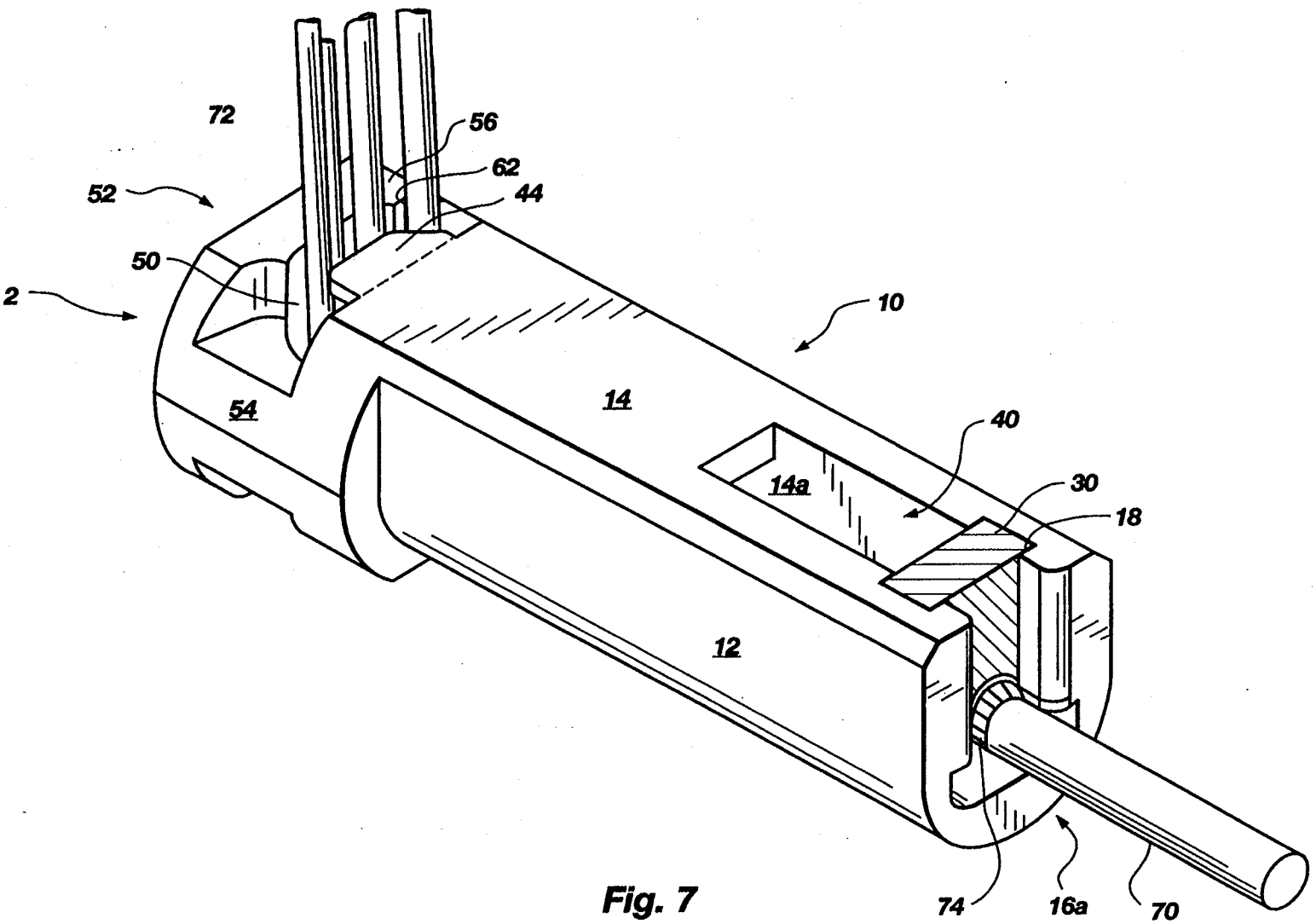
FIG. 7 shows a bottom perspective view of a detonator-to-shock tube connector having the U-shaped collar locked in place and having a plurality of shock tubes secured in the coupling portion.

FIG. 7 shows a detonator-to-shock tube connector 2 as it would commonly look during use. Extending from under the U-shaped collar 30 and out of the chamber 40 is a shock tube 70 and a portion of the casing 74, usually aluminum, which surrounds the shock tube and other components of the detonator assembly. Within the chamber 40, the shock tube 70 would be connected to a conventional detonator assembly. A plurality of shock tubes 72 is positioned in the shock tube coupling channel 50 such that ignition of the detonator assembly will initiate the shock tubes 72.

The instant connector will work with many types of detonator assemblies. For the most part, the detonator assembly will likely contain a static isolation cup disposed at the end of the shock tube 70 for dispersing static charges and preventing accidental ignitions. A sealer element or a transition element would be disposed adjacent to the static isolation cup for transferring an ignition signal to a delay train charge. The delay train charge, in turn, ignites an output charge which initiates the shock tubes.

In the manner described above, a simple, effective detonator-to-shock tube surface connector is provided. The system allows for better control of the detonator assembly, the shock tubes, and the explosive force caused by igniting an output charge. It is to be understood that the above-described arrangements are only illustrative of the application of the principles of the present invention. Numerous modifications and alternative arrangements may be devised by those skilled in the art without departing from the spirit and scope of the present invention, and the appended claims are intended to cover such modifications.

What is claimed is:

1. A detonator-to-shock tube ignition transfer connector for bi-directional explosive transfer from a detonator assembly to one or more shock tubes, wherein the connector comprises:

a connector housing having, an elongate barrel portion with an open first end and an open second end, said barrel portion including a wall having an inner surface defining an elongate hollow chamber formed lengthwise about a longitudinal axis of the barrel portion, for holding a detonator assembly, and a slotted opening in said wall extending from the first end into an intermediate part of the barrel portion to facilitate placement of a detonator assembly; and a resilient coupling having a first end and a second end, said coupling being attached at the first end to the second end of the barrel portion, and positioned so that the second end of the coupling is transverse to the longitudinal axis of the barrel portion so as to define a shock tube coupling channel between the coupling and the second end of the barrel portion, said channel being of sufficient size to receive a shock tube.

2. The connector of claim 1 wherein the coupling is generally L-shaped and wherein the second end is disposed adjacent to the second end of the barrel portion on a side of said second end of the barrel portion opposite the side of the second end of the barrel portion at which the first end of the coupling is attached.

3. The connection of claim 2 further comprising a flange extending from the second end of the barrel portion and toward the second end of the coupling so as to form a groove-type opening with the second end of the coupling.

4. The connector of claim 3 wherein the coupling is resilient and wherein the coupling and the groove-type opening form a latch and catch mechanism in which a shock tube may be slid into the shock tube coupling channel by placing a shock tube next to the groove type opening and pushing the shock tube toward the opening while applying a force to the unattached second end of the coupling portion in a direction away from the barrel portion.

5. The connector of claim 4 wherein the material comprising the coupling portion is sufficiently resilient to force the second end of the coupling portion to return to its original position once the shock tube has passed beyond the groove-type opening and external force is no longer being applied to said second end.

6. The connector of claim 1 further comprising at least one generally vertical groove disposed in the inner surface of the barrel portion, with at least one generally vertical groove being positioned along the slotted opening and disposed near the first open end of the barrel portion.

7. The connector of claim 6 further comprising at least one generally horizontal groove disposed in the inner surface of the barrel portion, said generally horizontal groove beginning at the open first end and intersecting the generally vertical groove, the generally horizontal groove being deeper than the generally vertical groove so as to create a generally horizontal lip along the inner surface of the barrel portion.

8. The connector of claim 7 further comprising a U-shaped collar lock, the lock being a separate piece of a width approximately equal to a width of the at least one generally vertical groove so as to allow complementary sliding of the U-shaped collar within said vertical groove.

9. The connector of claim 8 wherein the U-shaped collar lock comprises a resilient material.

10. The connector of claim 9 wherein the U-shaped collar lock further comprises at least one barb positioned near a top of the U-shaped collar, said barb having a flange complementary to the lip of the barrel portion.

11. The connector of claim 10 wherein the flange is disposed such that the resilient material of the U-shaped collar forces the flange to move horizontally over the lip when the barb passes the lip, thereby preventing the collar from being slid in an opposite vertical direction.

12. A detonator-to-shock tube ignition transfer connector for bi-directional explosive transfer from a detonator to one or more shock tubes, the connector comprising:

a connector housing having an elongate barrel portion with an open first end and an open second end, said barrel portion defining an elongate hollow chamber formed lengthwise about a longitudinal axis of the barrel portion, for holding a detonator assembly, and resilient retention means for locking a detonator assembly within the connector housing such that the detonator assembly cannot be accidentally removed from the housing, the retention means comprising generally U-shaped collar disposed along the barrel portion and locking means for holding the generally U-shaped collar along the barrel portion.

13. The detonator-to-shock tube surface connector of claim 12 wherein the elongate hollow chamber is defined by an inner wall of the barrel portion, and wherein the locking means comprises at least one groove disposed generally vertically within said inner wall.

14. A detonator-to-shock tube ignition transfer connector for bi-directional explosive transfer from an explosive element of a detonator assembly to one or more shock tubes, wherein the connector comprises:

a connector housing having, an elongate barrel portion with an open first end and an open second end, said barrel portion defining an elongate hollow chamber formed lengthwise about a longitudinal axis of the barrel portion, for holding a detonator assembly, the barrel portion defining a smaller diameter section near the open second end than at the open first end, and a resilient coupling having a first end and a second end, said coupling being attached at the first end to the second end of the barrel portion, and positioned so that the second end of the coupling is transverse to the longitudinal axis of the barrel portion so as to define a shock tube coupling channel between the coupling and the second end of the barrel portion, said channel being of sufficient size to receive a shock tube.

15. The connector of claim 14 wherein the smaller diameter section near the open second end is sized to provide a seat for an explosive component of a detonator assembly.

16. The connector of claim 14 wherein the barrel portion comprises a wall defining an inner surface of the barrel portion, the wall having a slotted opening extending from the first end into an intermediate part of the barrel portion to facilitate placement of a detonator assembly.

17. The connector of claim 14, further comprising resilient retention means for locking a detonator assembly within the connector housing such that the detonator assembly cannot be accidentally removed from the housing, the retention means being disposed along the barrel portion.

18. The connector of claim 17 wherein the barrel portion comprises at least one groove disposed adjacent the hollow chamber, and wherein the retention means comprises, a generally U-shaped collar slidably engageable in said groove so as to be lockable to the barrel portion to thereby secure the detonator assembly within the elongate hollow chamber of the elongate barrel.

* * * * *